US005329870A

United States Patent [19]

Cook

[11] Patent Number: 5,329,870

[45] Date of Patent: Jul. 19, 1994

[54] WATERCRAFT WITH VERTICALLY MOVABLE HYDROFOILS

[76] Inventor: Kenneth E. Cook, P.O. Box 6006, Lake Worth, Fla. 33466

[21] Appl. No.: 758,476

[22] Filed: Sep. 9, 1991

Related U.S. Application Data

[63] Continuation of Ser. No. 649,292, Jan. 30, 1991, abandoned, which is a continuation of Ser. No. 325,147, Mar. 17, 1989, abandoned.

[51] Int. Cl.[5] ..... B63B 1/28

[52] U.S. Cl. ..... 114/280; 114/279; 114/281; 114/282; 114/284; 114/285

[58] Field of Search ..... 114/271, 274–277, 114/279–287

[56] References Cited

U.S. PATENT DOCUMENTS

| | | | |
|---|---|---|---|
| 2,890,672 | 6/1959 | Boericke | 114/274 |
| 3,065,723 | 11/1962 | Tulin | 114/274 |
| 3,498,247 | 3/1970 | Handler | 114/274 |
| 4,356,786 | 11/1982 | Tuggle | 114/280 |

*Primary Examiner*—Robert J. Oberleitner
*Assistant Examiner*—Clifford T. Bartz
*Attorney, Agent, or Firm*—William D. Hall

[57] ABSTRACT

A watercraft employs three or more supercavitating hydrofoils. The elements that connect the hydrofoils to the hull may flex to thus raise or lower the hydrofoils relative to the hull. The relative motion between the hydrofoils and the hull is dampened by shock absorbers or the like. A control system operated by the pilot may apply forces tending to raise or lower the hydrofoils relative to the hull. The stern hydrofoil is mounted on a support that also carries a power driven propeller and a rudder.

17 Claims, 5 Drawing Sheets

WATERCRAFT WITH VERTICALLY MOVABLE HYDROFOILS

This is a continuation of co-pending application Ser. No. 07/649,292 filed on Jan. 30, 1991, which is a continuation of my application Ser. No. 07/325,147, filed Mar. 17, 1989, both now abandoned.

BACKGROUND OF THE INVENTION

Water, although soft and compliant at low speed, is hard and non-compressible at high speed. Therefore, a wave at 10 knots is displaced whereas at 100 knots is very difficult to displace. Travel over a surface at high speed requires an entirely different mechanism than traveling over that same surface at slow speed. The slow speed being that which we feel when a normal unassisted human contacts the water.

While traveling in a high velocity vehicle, the characteristics of a sea state can therefore appear to change so that resembling a hilly desert or rocky terrain which will rapidly destroy an un-cushioned or non-suspended vehicle attempting to travel across this surface at high speed.

The typical approach to high speed water travel has been hydroplanes or surface effect vehicles which rise slightly above the wave action either by:

(a) riding on a column of air trapped between two sponsons which contact the water surface. This action is known as flying "in ground effect" and, although possible, is inherently unstable, as executed by the typical hydroplane with no controllable air foils. This situation is like flying an airplane without horizontal and vertical stabilizers, trim, flaps etc., i.e., flight without control, precariously balanced on a column of air, subject to blow over with the slightest change of wind or wave condition.

(b) riding on a bubble of air created by forcing air into an area beneath the hull, which is encircled by a skirt or flexible seal, thereby creating an area of higher pressure beneath the hull which lifts the craft off the surface of the water. This system requires large docking or landing areas, similar to airports, in which to operate due to a lack of accurate steerage and immediate control.

SUMMARY OF THE INVENTION

The invention relates to hydrofoil watercraft and especially to supercavitating hydrocraft.

A plurality of hydrofoils are provided each of which is connected to the hull of the watercraft by a flexible connection. Such connection is rendered flexible in any of several ways. For example, the connection may be pivoted to the hull. Another example is that the connection itself may be resilient and, therefore, flexible.

The flexibility of the connection to each hydrofoil allows the hydrofoil (preferably a supercavitating hydrofoil) to move vertically relative to the hull. Suitable damping means is employed to dampen the vertical motion of the hydrofoil relative to the hull. Examples of such damping means include conventional shock absorbers similar in principle to those used on automobiles, helical coiled springs, and hydraulic pistons.

In a preferred form of the invention there are three supercavitating hydrofoils, one on the starboard side of the craft, one on the port side of the craft and one at the stern. Each such hydrofoil is connected to the hull by a wing. Each wing and hydrofoil moves vertically with reference to the hull by reason of any suitable means such as the pivots, resilient wing, or otherwise. Each wing and its complementary hydrofoil is affirmatively moved by a piston (located in a cylinder) driven by a fluid medium such as oil under pressure. A system of valves under the control of the pilot of the watercraft controls the oil pressure to each cylinder and thus enables the pilot to deflect each wing, together with its complementary hydrofoil, as desired in order to control the watercraft. The propeller and rudder are carried by the same wing that connects the stern hydrofoil to the hull.

DETAILED DESCRIPTION OF THE INVENTION

The present invention is characterized by the presence, in addition to three supercavitating hydrofoils 2, 3, 4, of a separate suspension system consisting, for example, of shock absorbers 9A, 9B and 7, mounted so as to dampen the shock from the hydrofoils to hull. The hull 1 is intentionally and specifically designed to be without positive air lift as opposed to other high performance boats, such as hydroplanes, which are designed with air lift. Some negative air lift may be employed to press the craft down in order to prevent kiting or blowover. The hull 1, at speed, is lifted out of the water above the waves and the suspended hydrofoil system is employed to work with and cut through the waves providing a smooth ride in the cabin area. Three hydrofoils 2, 3, 4, are used since this system is designed around either (A) the standard aircraft system, two hydrofoils forward, and one hydrofoil aft, or (B) a canard configuration having two hydrofoils aft and one hydrofoil forward. However, the invention does not limit itself to three only. More than three may be used to achieve the same or better results.

Figure 2:
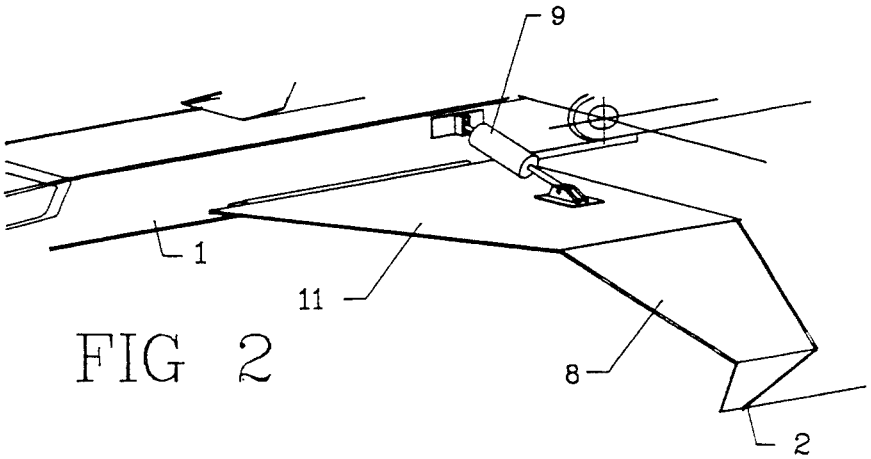
FIG. 2 is a perspective view of one forward port side wing, shocks, springs, strut and hydrofoil.

The forward aircraft configuration or wing system 11, 8 as shown in FIG. 2 is mounted so that the wings pivot along lines a—a, (FIG. 5) which lines are parallel to the fore and aft lines of the craft thereby allowing the lateral dihedral to decrease causing less vertical lift as the deflection increases. This then controls the roll of the craft. Further, the operation of the watercraft is enhanced by being independently controllable from inside the craft through the use of a hydraulic control system which may be used to move the wings and hydrofoils vertically relative to the hull, either manually, or by computer control, thereby increasing or decreasing the hull to water (or wave clearing) distance.

Figure 3:
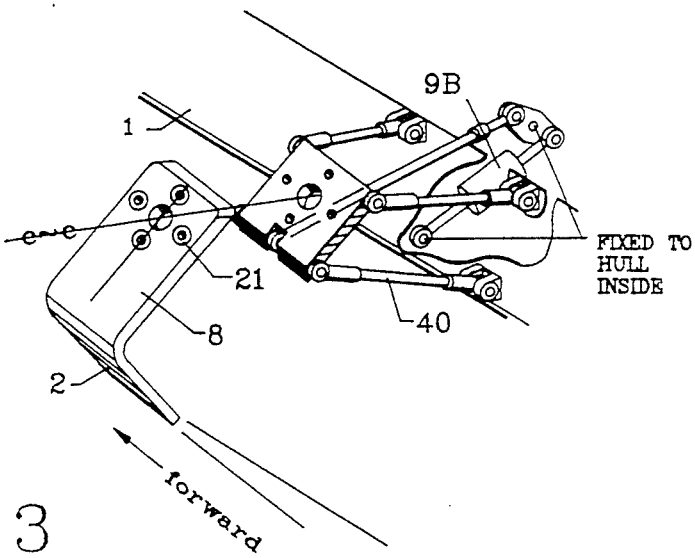
FIG. 3 is a perspective view of the alternate forward port side shock 9, strut 8, hydrofoil 2, and pivot point c—c.

The alternate forward aircraft configuration strut system as shown in FIG. 3 is mounted so that the a faired "A" frame suspension 40 pivots on lines closely adjacent the hull 1, and parallel to the fore and aft lines of the craft, thereby maintaining the lateral dihedral of the hydrofoil as the deflection increases or decreases. Further, they are enchanced by being independently controllable from inside the craft through the use of a hydraulic control system 9A which may be used to extend or retract the shock length either manually or by computer control thereby increasing or decreasing the hull to water (or wave clearing) distance. An additional benefit of the alternate forward strut system of FIG. 3 is the inboard mounting of the shock absorbers 9A to reduce air and water drag against the shock and suspension components. The stern hydrofoil 4 on the end of the suspension system pivots on an axis b—b perpendicular to a line parallel to the fore and aft line of the craft. Further, they are independently controllable from inside the craft to increase or decrease the angle of incidence.

The stern or tail hydrofoil 4 is spring and shock mounted so that the rear foil pivots on a line b—b perpendicular to a line parallel to the fore and aft lines of the craft thereby allowing the angle of the incidence of the rear foil 4 to decrease as the deflection increases. Further, this is independently controllable from inside the craft to increase the hull to water (wave clearance) distance and also to change the angle of incidence thereby controlling the pitch of the craft 1. The rear hydrofoil 4 incorporates the rear prop shaft bearing housing 6 which also pivots along with the above including the propeller 12 thereby changing the angle of incidence of the propeller thrust. This patent is not limited to a propeller thrust only and will work as well with a water or air jet, air propeller, or a rocket thrust propulsion system.

The hull 1, which is designed to be without air lift so as to prevent kiting or blowover typical to hydroplanes or other high performance vehicles, is supported at high speeds on the forward port hydrofoil 2, the forward starboard hydrofoil 3 and the stern hydrofoil 4.

The stern strut 5, supporting the stern hydrofoil 4, and the prop and shaft housing 6, is pivoted along the axis b—b (FIG. 7) which is in a plane perpendicular to the fore and aft lines of the craft.

Figure 9:
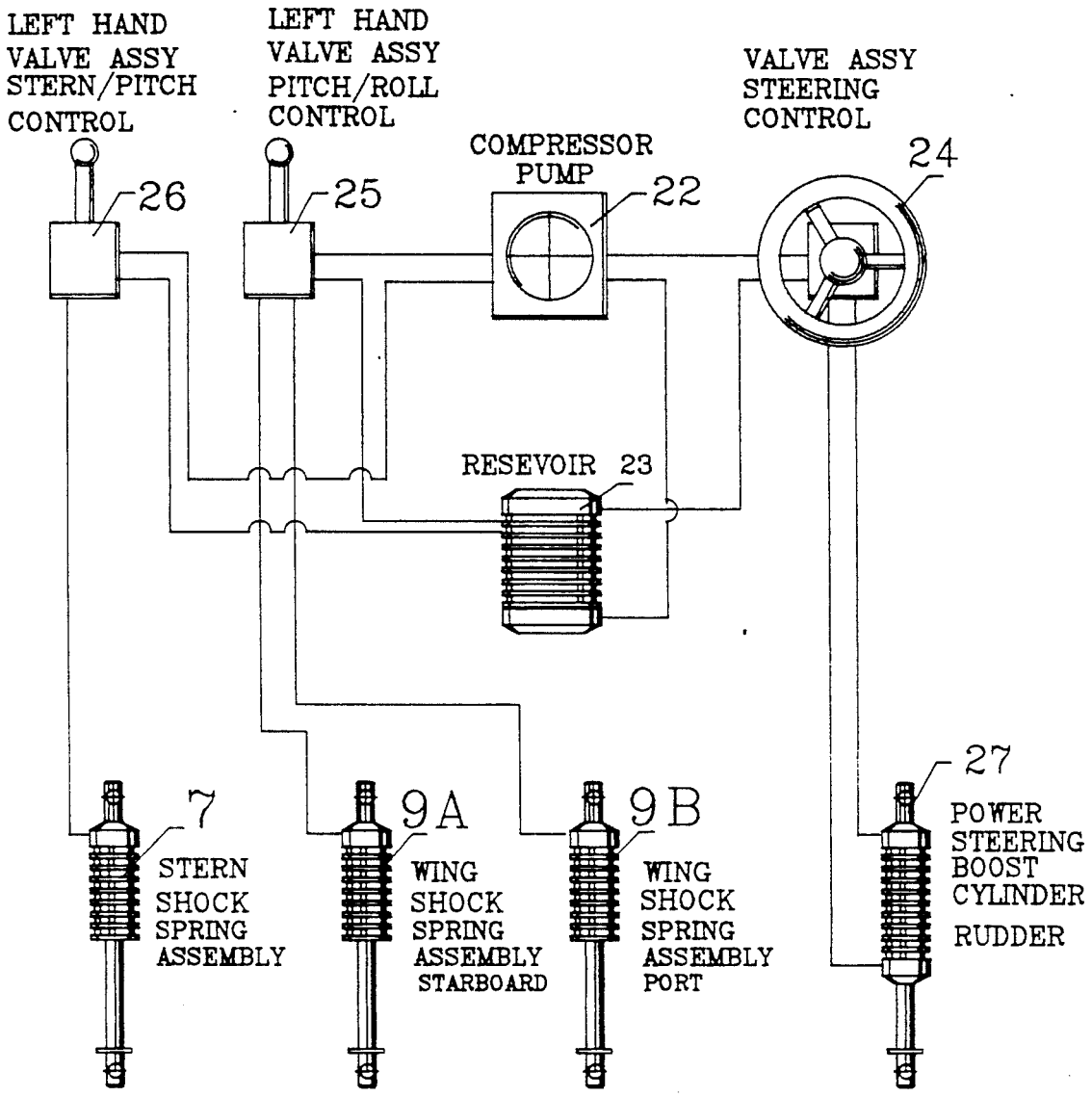
FIG. 9 is a schematic showing the components of the spring, shock, and steering column control enhancement.

This pivoting assembly is shock and spring dampened as shown in FIG. 9, by an air/hydraulic shock 7 which is further enhanced by a pressurized controllable system through the use of gas, hydraulics and mechanical means to raise and lower the entire stern assembly 4, 5, 6, 12, 16, which will in turn raise and lower the hull 1.

Figure 7:
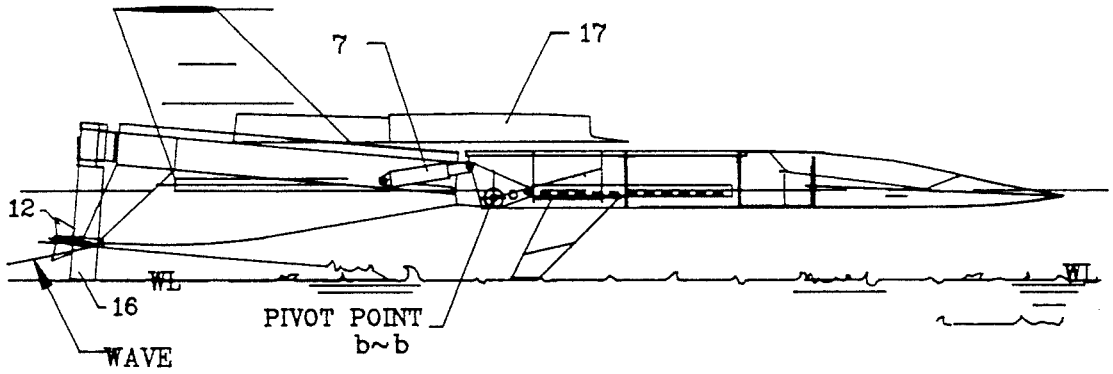
FIG. 7 is a side elevation of the craft showing the stern pivot point b—b.

This is done by either pushing the control valve 26 (FIG. 9) forward thereby extending the shock 7 and causing the stern assembly to pivot down on the pivot point b—b in FIG. 7, thereby increasing the angle of incidence of the stern hydrofoil 4 and simultaneously causing the propeller thrust to blow down which in turn controls the lift on the stern and the pitch of the entire craft, or by pulling the control valve 26 (FIG. 91 back thereby retracting shock 7 and causing the stern assembly to pivot up on the pivot point b—b (FIG. 7) thereby decreasing the angle of incidence of the stern hydrofoil 4 and simultaneously causing the propeller thrust to blow up thereby lowering the hull 1 and decreasing the wave to hull clearance.

The action of a large wave against the assembly 4, 5, 6, 12, 16, produces a large deflection thereby changing the angle of incidence of the stern hydrofoil 4 causing a large reduction of lift/drag whereas a small wave produces less deflection with less reduction in lift. This action works to dampen out wave induced, lift/drag and also produces a modulated wave surface tracking, thereby providing a smoother and more fuel efficient ride. A further benefit of this action is to provide more actual thrust by minimizing slip, freewheeling or broaching caused by the prop totally leaving the water as exhibited by other vessels without this improvement.

Figure 5:
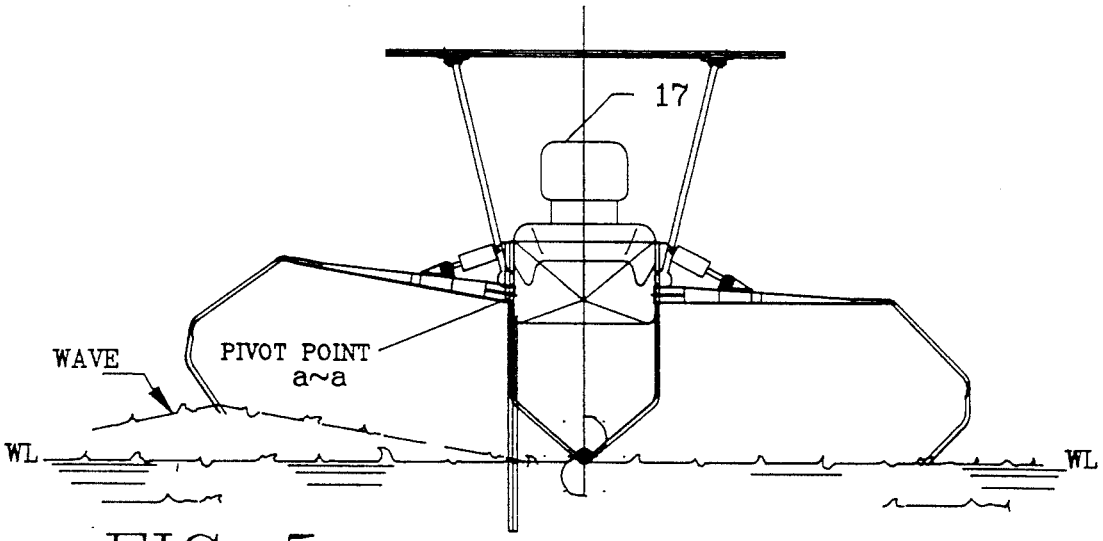
FIG. 5 is a front elevation of the craft showing the starboard wing, pivot point a—a, and the starboard strut 8 in the deflected position.

The forward starboard strut 8 supporting the forward starboard hydrofoil 3 and strut wing assembly 11 is pivotable along an axis a—a as shown in FIG. 5, which is in a plane parallel to the fore and aft lines of the craft. This pivoting assembly is also shock and spring dampened as shown in FIG. 9 by an air/hydraulic shock 9A which is further enhanced by a pressurized control system through the use of gas, hydraulics or mechanical means to raise or lower the entire assembly which will raise and lower the hull 1. This is done by either pushing the control valve 25 to the left thereby extending the starboard shock 9A and causing the wing assembly to pivot down on the pivot point a—a in FIG. 5, or by pushing the control valve 25 to the right thereby retracting starboard shock 9A and causing the wing assembly to pivot up on the pivot point a—a FIG. 5, thereby lowering the hull 1 on that side and changing the wave clearance height and center of gravity.

The forward port hydrofoil 3, strut 8 and wing 11 assembly, is similarly shock/spring mounted and pressure controllable and actuated in a mirror image of the starboard side thereby allowing roll control of the entire craft. The valve 25 (FIG. 9) may be pushed forward to raise both port and starboard assemblies simultaneously thereby lowering the hull 1 to the water or pulled back to raise the hull off the water. This action, when done independently of the stern control shock 7, may be used to control the pitch of the entire craft.

This suspension system may be alternately adjusted with an example being port assembly low, starboard assembly high so as to provide a banked turn to port. The reverse may also be used to initiate a banked starboard turn. It is important to note that the design "as is" without the benefit of the control system described in FIG. 9, is inherently stable and does not require the control system in order to operate. These controls are an enhancement to an inherently stable flight system. In other words, if the control system FIG. 9 is omitted and simple shock absorbers, or other means to dampen motion, is connected between each wing 5, 11, and the hull 1, the watercraft will have a stable operation.

Figure 8:
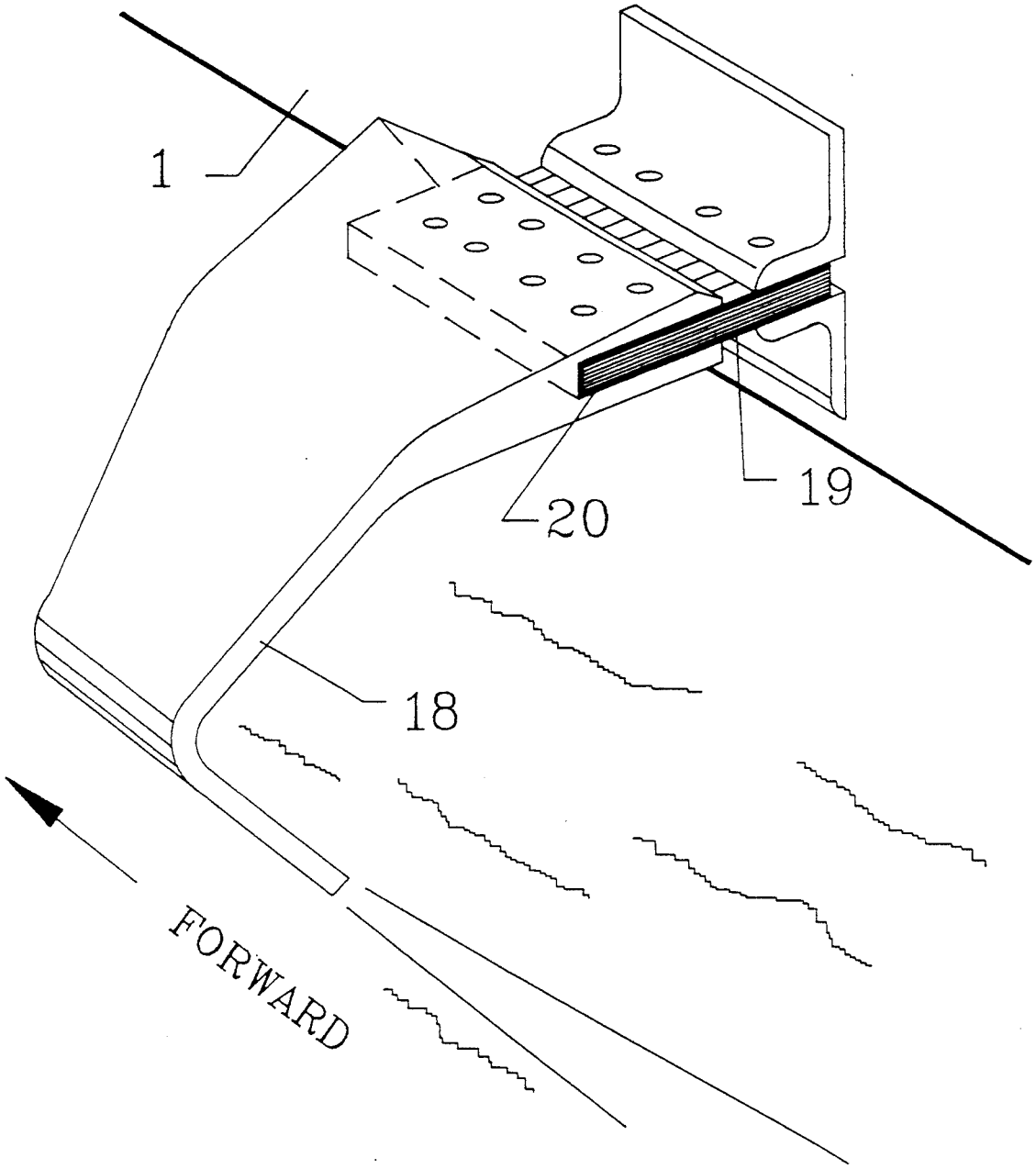
FIG. 8 is a perspective view of the composite forward port side wing/strut/hydrofoil 2.

FIG. 8 illustrates an alternative to the spring/shock pivot assembly described above. A composite one piece wing/strut/hydrofoil assembly 18 (FIG. 8) made of either carbon fiber epoxy (CFE), or Fiberglass reinforced plastic (FRP), has a foam, or honeycomb cell, core. A composite leaf spring 19 is embedded in polymer insulator 20, and is designed to be resilient and thereby flex in response to induced motion.

In FIG. 3 four shoulder bolts and a pivot pin (not shown) connects the suspension system to the strut 8. Strut 8 has elastic brushings 21 at the connection between the strut 8 and the "A" frame 40.

The "A" frame assembly 40 as shown in FIG. 3 is similar to state of the art high performance auto suspensions (not claimed as part of this patent) combined with an assembly that is pivoted along the axis c—c (which axis is in a plane perpendicular to the fore and aft lines of the craft).

This pivoting action is wave induced through higher frontal loads on the hydrofoil 2 forcing deflection of the elastic bushing 21 and causing a decreased angle of incidence on the hydrofoil thereby causing less lift. The means for pivoting this assembly is not limited to elastic bushings and can be any desired standard mechanism such as shock absorbers, levers, worm gears, hydraulics and motors.

Figure 1:
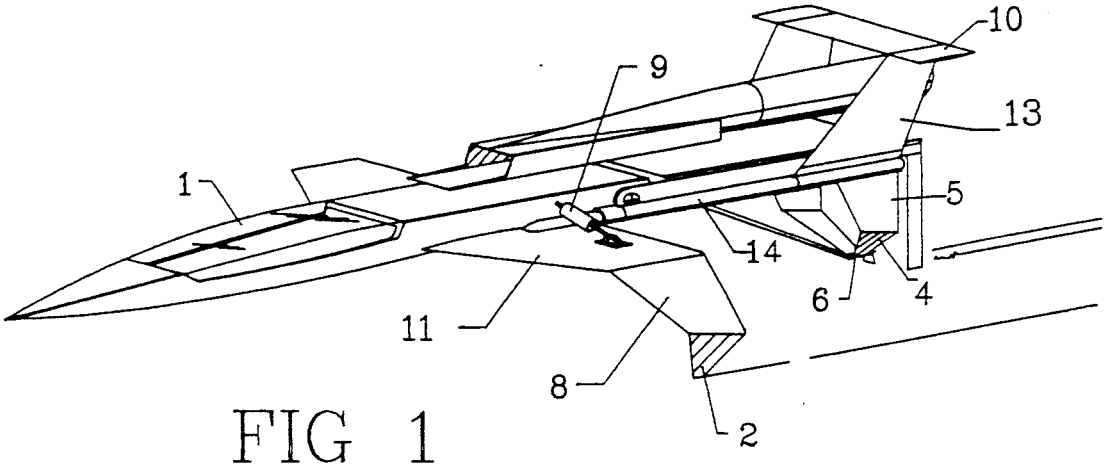
FIG. 1 is a perspective dynamic view of a hydrofoil watercraft on the surface of the water showing the component parts.
Figure 6:
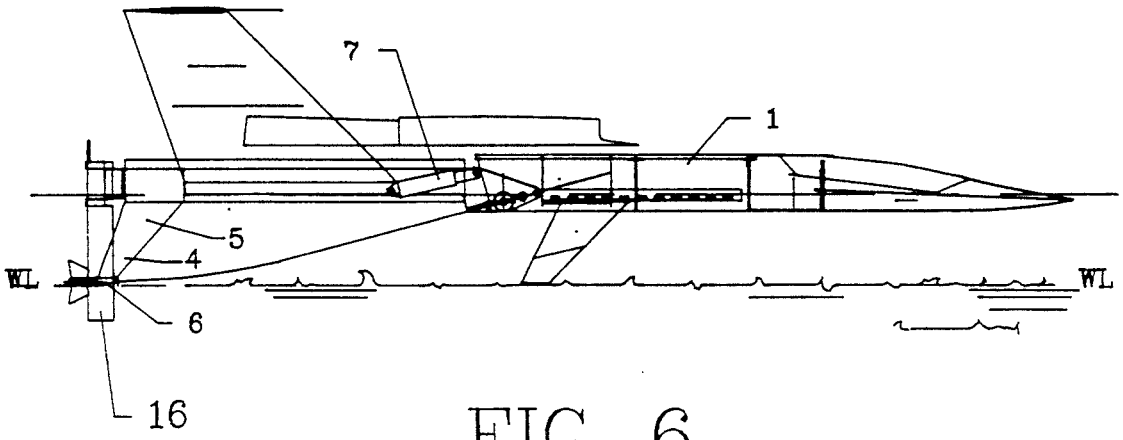
FIG. 6 is a side elevation of the craft of FIG. 3.

The tail as shown in FIG. 1 is comprised of a horizontal stabilizing airfoil 10 supported by two vertical stabilizers 13. Each stabilizer 13 is supported at its base or root by a long tubular beam 14 which is connected to the cabin but not to the pivotable stern 15 as shown in FIG. 6 and FIG. 7. Its function is to weatervane, stabilize, and counterbalance the cabin movement similar to the feathers on an arrow. It also assists in aligning the angle of attack. It does not move with the stern 15, as the stern works up and down tracking the waves, but is fixed to the cabin and assists in aligning the angle of attack. The stern motion is controlled and dampened by the stern shock 7 which can be lengthened or shortened by the control system shown in FIG. 9. This function can also be used to control height off the water and the pitch of the entire craft.

Figure 4:
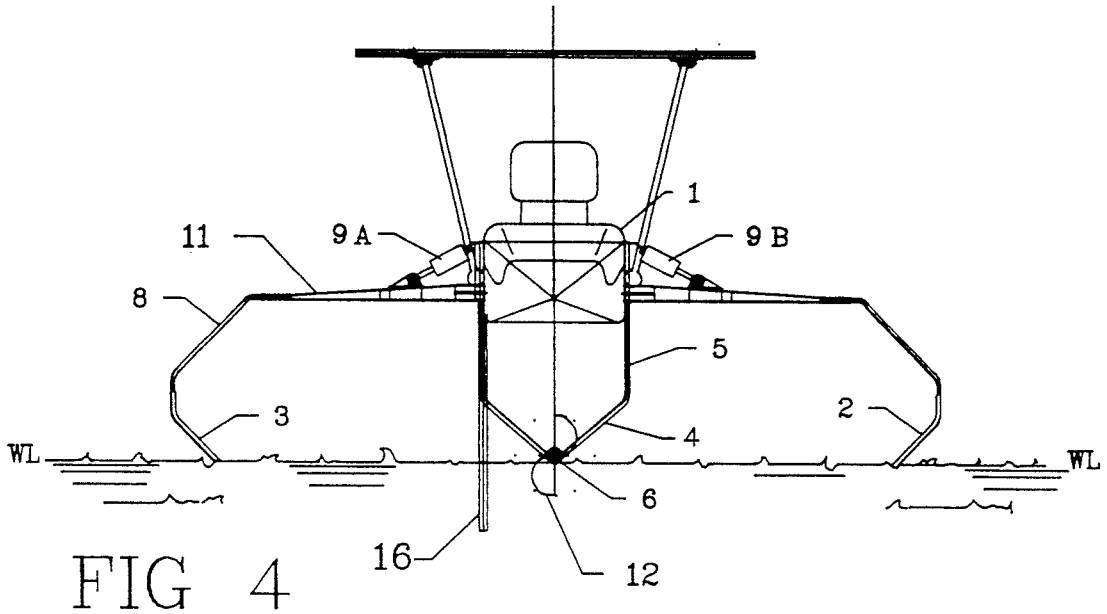
FIG. 4 is a front elevation of the craft showing the craft riding on the hydrofoils with the relationship to the water in the dynamic mode.

Steerage is accomplished in the standard fashion by means of a rudder 16 as shown in FIG. 4, which may be operated either independently or in conjunction with the pitch/roll/shock control system in FIG. 9. The steering wheel 24 works similar to most vehicles and turns a mechanical gear to produce a lineal motion which is transmitted to the rudder 16. This work load is reduced by addition of a hydraulic pump 22 and power steering boost cylinder 27 (FIG. 9). The rudder 16 is fixed to the stern 15 and moves with it in its wave tracking motion. This vehicle does not limit itself to a steering wheel and may use other means such as a joy stick, buttons or other mechanical form to interface from pilot to vehicle.

The rudder 16, along with propeller 12 and the propeller housing 6, is carried by the same mechanism that carries stern hydrofoil 4.

FIG. 9 employs conventional hydraulic control techniques for raising and lowering the hydrofoils 2, 3, 4, and for controlling the rudder 16. An oil reservoir 23 receives surplus oil from controls 24, 25, and 26, and provides a supply of oil for oil pump 22. The pump 22 supplies oil under pressure to steering control 24, to the left hand valve assembly pitch/roll control 25, and the left hand valve assembly stern/pitch control 26. The controls 24, 25 and 26 are in the watercraft where they can be operated by the pilot.

The steering control 24 controls the oil flow to cylinder 27, in the usual manner to control the position of rudder 16.

The handle on control valve 26 moves forwardly and rearwardly. When moved forward it feeds oil under pressure to cylinder 7 to move the stern assembly 4, 5, 6, 12 and 16 downwardly relative to the hull. When the handle of valve 26 is moved rearward, the oil pressure in cylinder 7 decreases and a spring (now shown), that is biasing the piston in cylinder 7, raises the stern assembly 4, 5, 6, 12 and 16.

The handle on valve 25 controls the vertical positions of the hydrofoils 2 and 3. When the handle of control valve 25 is moved to the left oil under pressure is fed to the cylinder 9A of the starboard hydrofoil 3, and oil flows from the port hydrofoil 2. The starboard hydrofoil 3, therefore, moves down relative to the hull 1 and the port hydrofoil 2 moves up (under spring action) relative to the hull 1. Similarly, when the handle of valve 25 is moved to the right, oil under pressure flows to cylinder 9B and the oil pressure in cylinder 9A declines. The port hydrofoil 2, therefore, moves down relative to the hull, and the biasing spring in cylinder 9A moves hydrofoil 3 upward relative to the hull.

When the handle of valve 25 is moved forward, oil pressure is fed from both of cylinders 9A and 9B forcing both of hydrofoils 2 and 3 up relative to the hull 1. Similarly, when the handle of valve 25 is moved rearward the oil pressure in both of cylinders 9A and 9B increases, and the biasing springs in both of cylinders 9A and 9B, move the hydrofoils 2 and 3 downward relative to the hull.

The hydrofoils 2, 3 and 4 are typical, conventional, supercavitating hydrofoils, although the invention can be practiced with subcavitating hydrofoils. A typical supercavitating hydrofoil is V-shaped (wedge shaped).

The propeller 12 is driven by a conventional turbine engine.

The term supercavitating speeds refers to speeds at and above the speed at which cavitation occurs.

I claim to have invented:

1. A supercavitating hydrofoil watercraft, comprising:

a hull, a plurality of supercavitating hydrofoils, a first means attached to said hull, for connecting at least one of said hydrofoils to said hull and for allowing said one hydrofoil to move vertically with reference to said hull, said first means comprising a projecting beam that projects laterally away from said hull and is substantially entirely above the water when the watercraft is moving at supercavitating speeds, said projecting beam having two ends, said one hydrofoil being carried near one of said ends, the other of said two ends being supported by said hull and constituting at least part of the support for said beam, and dampening means for dampening any vertical motion of at least said one hydrofoil while said watercraft is moving at a supercavitating speed.

2. A supercavitating hydrofoil watercraft as defined in claim 1, in which said dampening means comprises a shock absorber.

3. A supercavitating hydrofoil watercraft as defined in claim 1, in which said dampening means comprises a cylinder containing a fluid and a piston which moves in said cylinder to dampen said vertical motion.

4. A supercavitating hydrofoil watercraft as defined by claim 1, in which said first means includes a suspension system secured to said hull, for supporting one of said hydrofoils to provide movement of that hydrofoil relative to said hull, control means, and force producing means, under the control of said control means, for moving said one hydrofoil relative to said hull, while said watercraft is moving at a supercavitating speed, to exercise at least some control over the operation of said watercraft.

5. A super cavitating hydrofoil watercraft as defined in claim 1, comprising:

means for connecting each of said hydrofoils to said hull for movement relative to said hull, said dampening means dampening the movement of at least two of said hydrofoils relative to said hull while said watercraft is moving at a supercavitating speed.

6. A supercavitating hydrofoil watercraft, as defined in claim 1, comprising:

means, for applying negative air lift to said watercraft, to reduce the liklihood of blow-over.

7. A supercavitating hydrofoil watercraft as defined in claim 1, comprising:

three supercavitating hydrofoils and, means for supporting each of said three hydrofoils for movement relative to said hull, said dampening means dampening the movement of all three hydrofoils relative to said hull while said watercraft is moving at a supercavitating speed.

8. A supercavitating hydrofoil watercraft, comprising:

a hull, a plurality of supercavitating hydrofoils, first means attached to said hull, for connecting at least one of said hydrofoils to said hull and for allowing said one hydrofoil to move vertically with reference to said hull, dampening means for dampening any vertical motion of at least said one hydrofoil while said watercraft is moving at a supercavitating speed, and pivot means connecting said first means to said hull, so that said one hydrofoil may swing vertically relative to said hull, subject to the action of said damping means, when the watercraft is moving at a supercavitating speed.

9. A supercavitating hydrofoil watercraft comprising:

a hull, a starboard supercavitating hydrofoil, a port supercavitating hydrofoil, first means connecting said starboard supercavitating hydrofoil to said hull for varying the elevation of said starboard supercavitating hydrofoil relative to said hull white said watercraft is moving at a supercavitating speed, second means connecting said port supercavitating hydrofoil to said hull for varying the elevation of said port supercavitating hydrofoil relative to said hull, while said watercraft is moving at a supercavitating speed, control means for controlling said first means and said second means to vary the elevations of said hydrofoils relative to said hull while said watercraft is moving at supercavitating speeds, a third supercavitating hydrofoil, and third means connecting said third supercavitating hydrofoil to said hull, said control means including means for moving said third means relative to said hull to vary the elevation of said third supercavitating hydrofoil relative to said hull.

10. A supercavitating hydrofoil watercraft as defined in claim 9, in which, each of said first means, said second means and said third means includes a strut.

11. A supercavitating hydrofoil watercraft comprising:

a hull, a starboard supercavitating hydrofoil, a port supercavitating hydrofoil, first means, comprising a first elongated element having one end attached to said hull and having another end attached to said starboard supercavitating hydrofoil with said first element and its associated hydrofoil constituting a cantilever member for connecting said starboard supercavitating hydrofoil to said hull, for varying the elevation of said starboard supercavitating hydrofoil relative to said hull while said watercraft is moving at a supercavitating speed, second means, comprising a second elongated element having one end attached to said hull and having another end attached to said port supercavitating hydrofoil with said second element and its associated hydrofoil constituting a cantilever member for connecting said port supercavitating hydrofoil to said hull, for varying the elevation of said port supercavitating hydrofoil relative to said hull while said watercraft is moving at a supercavitating speed, and control means for jointly controlling said first means and said second means by moving said elements to vary the elevations of said hydrofoils relative to said hull while said watercraft is moving at supercavitating speeds, said control means vertically swinging each said element over substantially its entire length to vary the elevation, of the hydrofoil associated with the element, relative to said hull.

12. A supercavitating hydrofoil watercraft as defined in claim 11, comprising:

a third supercavitating hydrofoil.

13. A supercavitating hydrofoil watercraft as defined claim 12, in which all three of the supercavitating hydrofoils are wedge shaped.

14. A supercavitating hydrofoil watercraft as defined claim 12, comprises:

three struts, each of said supercavitating hydrofoils being connected to said hull by one of said three struts.

15. A supercavitating hydrofoil watercraft, as defined in claim 11, comprising:

means, for applying negative air lift to said watercraft, to reduce the liklihood of blow-over.

16. A hydrofoil type of watercraft, comprising:

a hull, a plurality of supercavitating hydrofoils, connecting means connected to said hull for supporting one of said hydrofoils, control means for moving said connecting means relative to said hull for changing the elevation of said one hydrofoil relative to said hull, to thereby at least partially control said watercraft, a propeller, for driving said watercraft, supported on said connecting means and moving relative to said hull when said one hydrofoil moves relative to said hull.

17. A hydrofoil type of watercraft as defined in claim 16, comprising:

a rudder, for steering said watercraft, mounted on said connecting means and movable relative to said hull when said one hydrofoil moves relative to said hull.

* * * * *